United States Patent [19]

Wisner

[11] 4,437,203

[45] Mar. 20, 1984

[54] CLEANING HEAD FOR WALL WASHING MACHINES

[76] Inventor: John A. Wisner, 701 S. Luzerne Ave., Baltimore, Md. 21224

[21] Appl. No.: 386,429

[22] Filed: Jun. 8, 1982

[51] Int. Cl.[3] ..... A47L 7/00

[52] U.S. Cl. ..... 15/322

[58] Field of Search ..... 15/320, 321, 395

[56] References Cited

U.S. PATENT DOCUMENTS

| | | | |
|---|---|---|---|
| 3,195,166 | 7/1965 | Wisner | 15/322 |
| 3,464,081 | 9/1969 | Wisner | 15/322 |
| 3,591,889 | 7/1971 | Wisner | 15/322 |
| 3,862,466 | 1/1975 | Jabsen | 15/320 |

*Primary Examiner*—Philip R. Coe

*Attorney, Agent, or Firm*—D. Paul Weaver

[57] ABSTRACT

A simplified and more convenient cleaning head for a wall washing machine includes a shell adapted for holding in the hand or mounting at one end of an elongated wand and also adapted to receive cleaning and rinse fluid lines contained in a vacuum hose attached to the shell. A fluid distribution manifold having a hinged connection in one end of the shell receives cleaning and rinsing fluids from a fluid switching valve in the shell and also serves to securely retain a replaceable sponge insert within the shell without the necessity of employing other fastening means for the sponge insert.

7 Claims, 9 Drawing Figures

CLEANING HEAD FOR WALL WASHING MACHINES

BACKGROUND OF THE INVENTION

Prior U.S. Pat. Nos. 3,195,166; 3,464,081; and 3,591,889 to Wisner disclose wall, floor and ceiling washing machines in which detergent and rinse fluids are delivered through separate tubes contained in a vacuum hose to a cleaning head which can be held in the hand or secured to a wand, if preferred. In these prior art machines, the cleaning and rinse fluids are delivered through the cleaning head to a wall, floor or ceiling surface and are drawn away from the cleaning head by suction in a continuous operating cycle.

The present invention seeks to improve on the constructions and convenience of use of the cleaning heads employed in the prior art wall, floor and ceiling washing machines. More particularly, the object of the invention is to simplify the construction of the cleaning head, reduce its manufacturing cost, and render it much easier for a user to remove and replace the sponge cleaning element at proper times. With this objective in mind, a major feature of the present invention is to employ the fluid distribution manifold contained in the cleaning head for a dual purpose of securely retaining the sponge insert in place within the shell of the head, while facilitating its easy replacement at required times.

Another object of the invention is to provide a fluid distribution manifold within the cleaning head which is pivotally attached near one end to the shell of the head so that it can be readily swung to and away from a sponge element retaining position.

Other features and advantages of the invention will become apparent during the course of the following detailed description.

DETAILED DESCRIPTION

Figure 1:
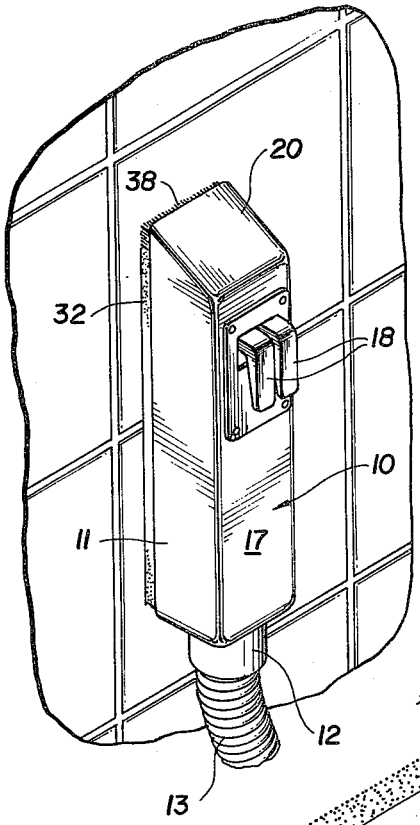
FIG. 1 is a perspective view of a cleaning head for a wall washing machine embodying the features of the present invention.
Figure 2:
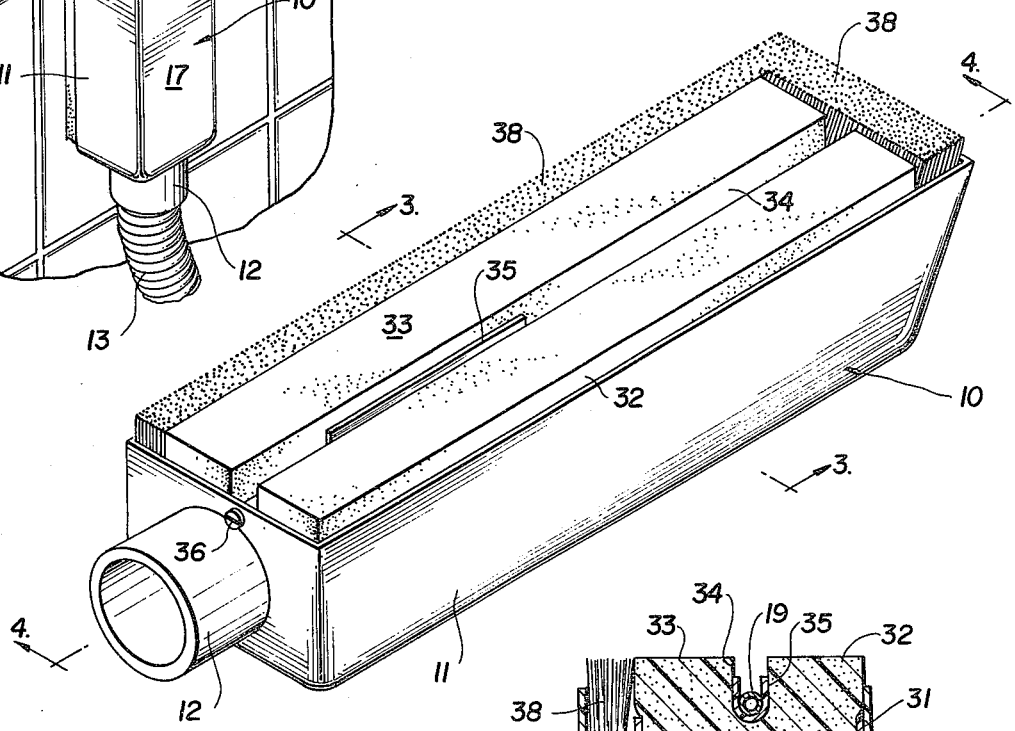
FIG. 2 is a bottom perspective view of the cleaning head shown in FIG. 1.
Figure 3:
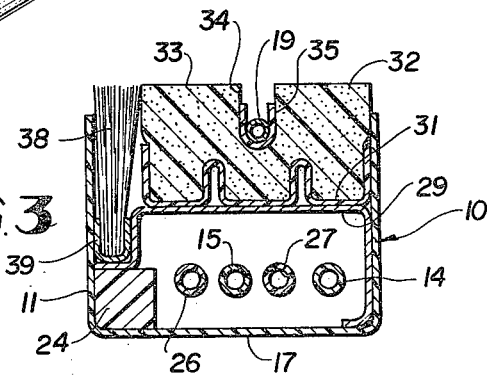
FIG. 3 is a transverse vertical section taken on line 3—3 of FIG. 2.
Figure 4:
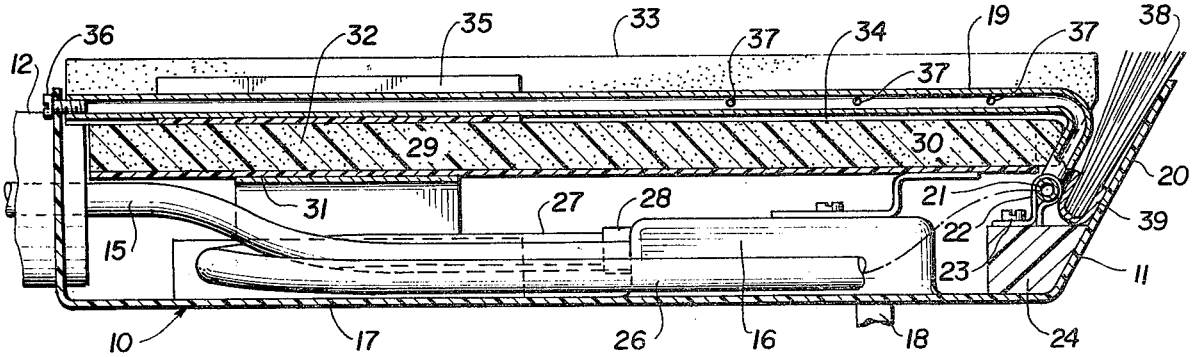
FIG. 4 is a longitudinal vertical section taken on line 4—4 of FIG. 2.
Figure 5:
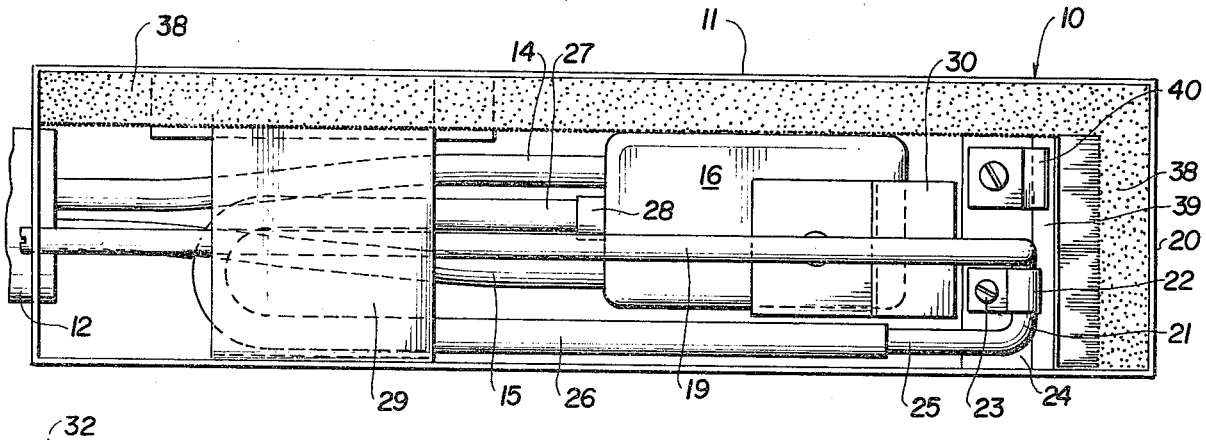
FIG. 5 is a bottom plan view of the cleaning head with its sponge element removed to clarify the construction of other components.
Figure 6:
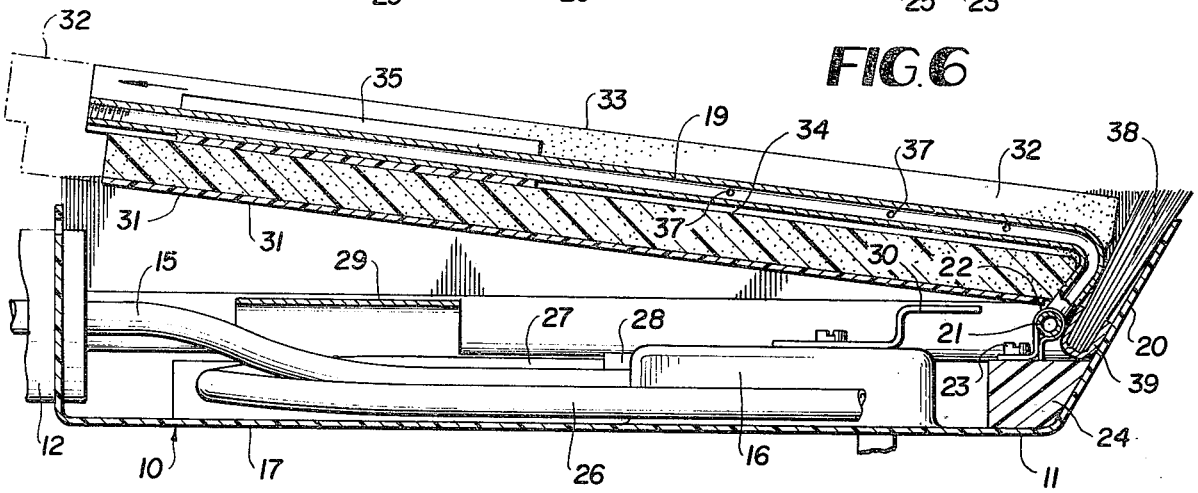
FIG. 6 is a view similar to FIG. 4 showing the fluid distribution manifold swung to a sponge element release position.

Referring to the drawings in detail wherein like numerals designate like parts, and referring first to FIGS. 1 through 6, a hand-held cleaning or washing head 10 for a wall washing machine of the type disclosed in the referenced prior patents comprises an exterior generally rectangular shell 11 formed of plastics or the like. The interior side of the shell 11 which would face a wall surface undergoing cleaning is open, as clearly shown in FIG. 2. The manual cleaning head 10 whose shape is defined by the shell 11 is elongated. At one of its end walls, the shell 11 has a swivel fitting 12 secured thereto, such fitting being connected to a vacuum hose 13 connected with a remote vacuum source. Within the vacuum hose 13, separate tubes 14 and 15 for detergent and rinse water lead into the shell 11 and are connected therein with a fluid switching valve 16 which is suitably attached to the outer or top wall 17 of the shell 11. The switching valve 16 has finger-operated selector levers 18 at the exterior of the shell top wall 17 near one end of the cleaning head, by means of which either detergent fluid or rinsing fluid can be directed to a fluid distribution manifold 19 of the cleaning head, forming an important component of the invention.

The manifold 19 comprises a straight section of tubing preferably formed of brass of the like extending lengthwise of the cleaning head 10 near its transverse center although offset somewhat to one side of the longitudinal center line of the head 10. In its use position, FIGS. 3 and 4, the manifold 19 is disposed just inwardly of the open side of shell 11 in parallel relationship to the wall 17 and the side walls of the shell. The manifold 19 extends for nearly the full length of the shell 11.

Near a sloping end wall 20 of the shell, the manifold 19 has a depressed bight 21 pivotally anchored by a clamp 22, secured by the screw 23 to a fixed block 24 within the shell 11 near its forward closed corner. The manifold 19 is freely pivoted and swingable on the axis of its bight 21 within the clamp 22.

From the bight 21 a short extension 25 of the manifold tubing is coupled to a flexible tube 26 which extends toward the far end of the shell 11 where it is looped to form a parallel branch 27 coupled to an outlet fitting 28 of the switching valve 16.

As explained in said prior patents, a user of the cleaning head 10 by selecting and depressing the proper lever 18 may deliver either detergent or rinsing fluid supplied through the lines 14 and 15 from the switching valve 16 with which the levers 18 are operatively connected to the distribution manifold 19.

This mode of connection remains unchanged in the present invention and need not be further described.

A protective clip 29 bridges the several exposed tubes 14, 15, 26 and 27 within the shell 11 to protect them from crushing. The top wall of this clip 29 and the offset wall 30 of another clip fixed to the case of switching valve 16 form support surfaces for the plastic backing 31 of a renewable cleaning sponge insert 32 when the latter is in the use position, FIGS. 3 and 4. In such position, the working face 33 of the sponge insert projects slightly beyond the open side of the shell 11, as shown.

The sponge element has a longitudinal center groove 34 formed therein from end-to-end. The rearward end portion of this groove is preferably reinforced or lined by a plastic channel element 35. With the plastic backing 31 of the sponge insert resting solidly on support brackets 29 and 30, the pivoted manifold 19 can be swung on the axis of its bight 21 to enter the groove 34 and enter the reinforcing channel 19 therein snugly and with stability. A single screw 36 is then employed to releasably secure the manifold 19 within the channel 35. In this manner, the fluid distribution manifold 19 simultaneously serves to retain the renewable sponge insert in the operational position of the cleaning head while delivering either detergent or rinse fluid to the head, as described in the prior patents. For this latter purpose, the manifold tubing is apertured at multiple points along its length between the channel element 35 and bight 21, as shown at 37.

When it is desired to replace the sponge insert 32 with a fresh one, it is only necessary to back off the screw 36 and swing manifold 19 with the element 32 to an inclined release position somewhat above the open side of the shell 11. In this position, the entire sponge insert, with its attached backing 31 and channel element 35, can readily be removed in the direction of the arrow shown in FIG. 6, and replaced by a new sponge insert.

Preferably, as disclosed in the prior referenced patents, scrubbing bristles 38 held in a channel backing 39 extend across the leading end of the head 10 and longitudinally along one side thereof between one side of the sponge element 32 and the adjacent side wall of plastic shell 11. The working ends of the bristles 38 are approximately flush with the working face 33 of sponge insert 32. The bristles 38 can be anchored within the shell 11 at appropriate points as by clips 40 bearing on the channel backing 39, FIG. 5.

As described in the referenced patents, detergent fluid or rinse fluid can be selectively delivered through the manifold 19 to the renewable sponge element 32 which engages the surface undergoing cleaning. Simultaneously, suction in the hose 13 communicating with the interior of shell 11 withdraws the fluid from the wall surface in a continuous efficient cycle of operation. The present invention, as described, is concerned with a better and more convenient arrangement for retaining the replaceable sponge insert 32 and allowing its easy replacement when required by manipulating only a single screw and swinging the manifold 19 outwardly.

Figure 7:
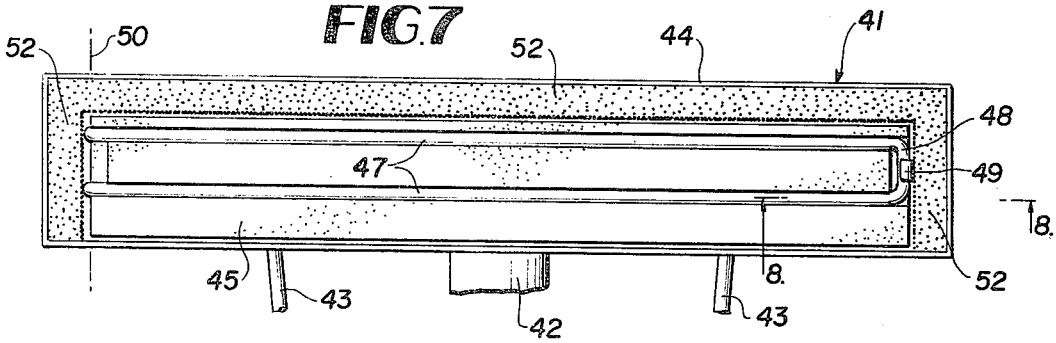
FIG. 7 is a bottom plan view of a wand attached cleaning head constructed according to the invention.
Figure 8:
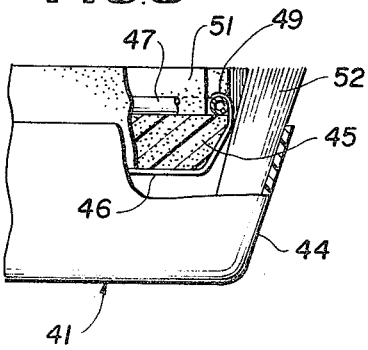
FIG. 8 is an enlarged fragmentary vertical section taken on line 8—8 of FIG. 7.
Figure 9:
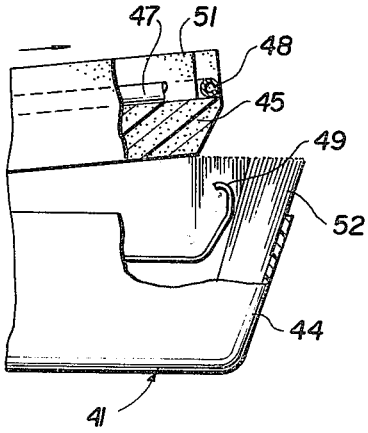
FIG. 9 is a similar view showing the cleaning fluid distribution manifold and sponge element in a release position similar to FIG. 6.

FIGS. 7 to 9 show a variant of the invention in which a cleaning head 41 made according to the invention is carried from the leading end of an elongated wand 42 having side braces 43 to stabilize the head 41. The head 41 has an outer shell 44 similar to the shell 11 and within which a renewable sponge insert 45 with rigid backing 46 is releasably held by a dual parallel branch fluid distribution manifold 47. At one end, this manifold has a bight 48 adapted to be engaged by a hook-like retaining spring 49 within the cleaning head, the far end of the manifold being pivoted to the head on a transverse axis 50 corresponding to the pivot means 22 of manifold 19. The sponge insert 45 is grooved at 51 in its working face to receive the two branches of the manifold 47 which are suitably perforated along their lengths to deliver fluids to the sponge.

The sponge insert is surrounded on three sides, FIG. 7, by scrubbing bristles 52 similar to the described bristles 38. The fluid switching valve 16 and control levers 18, not shown, are located near the far end of the wand 42 for convenience of operation rather than inside of the cleaning head 41. In other respects, the head 41 is basically the same as the head 10 and possesses the same cleaning mode of operation previously described.

When it is required to change the sponge insert 45, the retainer spring 49 is merely flexed and released from engagement with the bight 48 of the fluid distribution manifold, thus allowing the manifold 47 and insert 45 to swing on the pivot axis 50 to an angled release position. Upon replacement of the insert 45, the bight 48 is simply snapped under the retaining spring 49 which securely locks the insert 45 and manifold in the normal use position, FIG. 8. The form of the invention in FIGS. 7 through 9 does not require any tools to replace the sponge insert or element. Both forms of the invention are extremely simple and convenient to use and comparatively inexpensive to manufacture. They both possess clear advantages over the known prior art and facilitate the cleaning mode of operation wherein cleaning fluids are delivered to a wall surface and removed therefrom in a continuous process by use of a single cleaning head or implement.

It is to be understood that the forms of the invention herewith and shown and described are to be taken as preferred examples of the same, and that various changes in the shape, size and arrangement of the parts may be resorted to, without departing from the spirit of the invention or scope of the subjoined claims.

I claim:

1. A cleaning head for a wall washing machine or the like comprising a shell, conduit means connected with the shell to deliver cleaning and rinsing fluids thereto selectively and to withdraw such fluids in a continuing cycle of operation, a fluid distribution manifold extending longitudinally of the shell and being within the shell during normal operation and having one end thereof pivotally connected with the shell so that the manifold is swingable with relation to the shell to a sponge insert release position, a retainer means on the shell to releasably secure the other end of the manifold in said normal use position within the shell substantially parallel to the longitudinal axis of the cleaning head, a replaceable sponge insert for the cleaning head of a size to engage within the shell and being longitudinally recessed to receive said manifold below the working face of the sponge insert and being bodily swingable with the manifold to and from said release position, said retainer means comprising a single removable fastener element engageable with the other end of the manifold and with one end wall of the shell, the manifold comprising a single tube section having one end portion screw-threaded, the fastener element comprising a screw engaging the screw-threads of the manifold, and said one end of the manifold being shaped to provide a transverse bight adapted for connection with said conduit means within said shell, said bight forming the pivot element for the manifold, and a coacting anchored pivot element within the shell engaging the bight to maintain it on a fixed pivot axis relative to the shell.

2. A cleaning head as defined in claim 1, and said sponge insert having an attached substantially stiff backing, and fixed support surfaces within the shell engaging and supporting said backing when the sponge insert is in said normal use position.

3. A cleaning head as defined in claim 1, and said retainer means comprising a retainer spring within said shell near one end thereof releasably engageable with the end of the manifold away from the pivot of the manifold.

4. A cleaning head as defined in claim 3, and the manifold comprising a dual branch manifold having a bight at one end thereof, and said retainer spring being engageable with said bight.

5. A cleaning head as defined in claim 4, and the retainer spring comprising a hook-like spring element adapted to snap over said bight of the manifold.

6. A cleaning head as defined in claim 1, and said shell and sponge insert being elongated and approximately in the form of a rectangular parallelepiped, the sponge insert being disposed closely adjacent to one longitudinal side wall and one end wall of said shell and being spaced from the other side wall and end wall of the shell, and an abrasive scrubbing element held within the space between the sponge insert and said other side and end wall of the shell, the working faces of the sponge insert and the abrasive scrubbing element being approximately flush.

7. A cleaning head as defined in claim 6, and the abrasive scrubbing element comprising a brush.

* * * * *